US010117015B2

(12) United States Patent
Armstrong et al.

(10) Patent No.: US 10,117,015 B2
(45) Date of Patent: Oct. 30, 2018

(54) EARPHONES OPTIMIZED FOR USERS WITH SMALL EAR ANATOMY

(71) Applicant: LOGITECH EUROPE, S.A., Lausanne (CH)

(72) Inventors: Judd Armstrong, Parrearra (AU); Stephen Duddy, Moama (AU)

(73) Assignee: LOGITECH EUROPE, S.A., Lausanne (CH)

( * ) Notice: Subject to any disclaimer, the term of this patent is extended or adjusted under 35 U.S.C. 154(b) by 80 days.

(21) Appl. No.: 14/918,500

(22) Filed: Oct. 20, 2015

(65) Prior Publication Data

US 2017/0111727 A1 Apr. 20, 2017

(51) Int. Cl.
*H04R 25/00* (2006.01)
*H04R 1/10* (2006.01)

(52) U.S. Cl.
CPC ..... *H04R 1/1075* (2013.01); *H04R 1/1016* (2013.01)

(58) Field of Classification Search
CPC .. H04R 31/006; H04R 1/1075; H04R 1/1016; H04R 1/10; H04R 2201/10; H04R 2460/13
USPC ..... 381/380
See application file for complete search history.

(56) References Cited

U.S. PATENT DOCUMENTS 2,189,096 A 2/1940 Alonge
3,543,724 A 12/1970 Kirkpatrick et al.
3,978,849 A 9/1976 Geneen
4,129,124 A 12/1978 Thalmann
4,224,984 A 9/1980 Cramer et al.
4,307,727 A 12/1981 Haynes
4,331,154 A 5/1982 Broadwater et al.
4,407,295 A 10/1983 Steuer et al.
4,409,983 A 10/1983 Albert
4,491,970 A 1/1985 Lawhite et al.
5,301,154 A 4/1994 Suga
5,392,261 A 2/1995 Hsu
5,406,952 A 4/1995 Barnes et al.
5,524,637 A 6/1996 Erickson
5,734,625 A 3/1998 Kondo
5,755,623 A 5/1998 Mizenko
(Continued)

OTHER PUBLICATIONS

"Watch Stylish Blue Light LED Round Dial Matrix Stainless from ChinaBuye.com" by YnopoB. YouTube [dated Apr. 23, 2012][online][retrieved on Dec. 31, 2015] (https://www.youtube.com/watch?v=e_LWbXHvvWg).
(Continued)

*Primary Examiner* — Phylesha Dabney
(74) *Attorney, Agent, or Firm* — Patterson & Sheridan, LLP

(57) ABSTRACT

An earphone audio device includes a housing, a speaker component, and a step-styled tip wherein the tip comprises a mid-section and a leading-section, the leading section having a smaller radial profile than the mid-section, and the speaker component is at least partially disposed within the aperture formed by the interior wall of the mid-section. In some embodiments, the speaker component may be entirely disposed within the mid-section such that no part of the speaker component extends toward the housing of the earphone beyond the aperture formed by the mid-section.

20 Claims, 5 Drawing Sheets

(56) References Cited

U.S. PATENT DOCUMENTS

| | | | | |
|---|---|---|---|---|
| 5,899,370 | A | 5/1999 | Bould | |
| 6,151,968 | A | 11/2000 | Chou | |
| 6,361,503 | B1 | 3/2002 | Starobin et al. | |
| 6,736,759 | B1 | 5/2004 | Stubbs et al. | |
| 7,192,401 | B2 | 3/2007 | Saalasti et al. | |
| 7,717,827 | B2 | 5/2010 | Kurunmaki et al. | |
| 7,914,425 | B2 | 3/2011 | Hanoun | |
| 8,280,094 | B2 * | 10/2012 | Lehdorfer | H04R 1/1075 381/328 |
| 8,992,385 | B2 | 3/2015 | Lemos | |
| 9,532,127 | B2 * | 12/2016 | Burton | H04R 1/1016 |
| 9,571,912 | B2 * | 2/2017 | Siahaan | B29C 43/021 |
| 2002/0151811 | A1 | 10/2002 | Starobin et al. | |
| 2002/0188210 | A1 | 12/2002 | Aizawa | |
| 2003/0065269 | A1 | 4/2003 | Vetter et al. | |
| 2005/0056655 | A1 | 3/2005 | Gary | |
| 2005/0116811 | A1 | 6/2005 | Eros et al. | |
| 2005/0256416 | A1 | 11/2005 | Chen | |
| 2006/0183980 | A1 | 8/2006 | Yang | |
| 2007/0118043 | A1 | 5/2007 | Oliver et al. | |
| 2008/0132383 | A1 | 6/2008 | Einav et al. | |
| 2008/0228089 | A1 | 9/2008 | Cho et al. | |
| 2009/0312656 | A1 | 12/2009 | Lau et al. | |
| 2010/0177904 | A1 * | 7/2010 | Sung | G10K 11/1788 381/71.6 |
| 2010/0197463 | A1 | 8/2010 | Haughay, Jr. et al. | |
| 2010/0220884 | A1 * | 9/2010 | Aquilina | H04R 25/608 381/328 |
| 2011/0021319 | A1 | 1/2011 | Nissila et al. | |
| 2011/0092790 | A1 | 4/2011 | Wilder-Smith et al. | |
| 2011/0260870 | A1 | 10/2011 | Bailey | |
| 2012/0022341 | A1 | 1/2012 | Zdeblick | |
| 2012/0168471 | A1 | 7/2012 | Wilson | |
| 2012/0253485 | A1 | 10/2012 | Weast et al. | |
| 2013/0064049 | A1 | 3/2013 | Pileri et al. | |
| 2013/0237778 | A1 | 9/2013 | Rouquette | |
| 2014/0032234 | A1 | 1/2014 | Anderson | |
| 2014/0073486 | A1 | 3/2014 | Ahmed et al. | |
| 2014/0107493 | A1 | 4/2014 | Yuen et al. | |
| 2014/0138179 | A1 * | 5/2014 | Burton | H04R 1/1016 181/135 |
| 2014/0211977 | A1 * | 7/2014 | Armstrong | H04R 1/105 381/380 |
| 2014/0228175 | A1 | 8/2014 | Lemos et al. | |
| 2016/0269817 | A1 * | 9/2016 | Basseas | H04R 1/1016 |
| 2016/0301999 | A1 * | 10/2016 | Lott | H04R 1/1016 |
| 2016/0373852 | A1 * | 12/2016 | Kirkpatrick | H04R 1/1016 |
| 2017/0041701 | A1 * | 2/2017 | Cheng | H04R 1/1083 |

OTHER PUBLICATIONS

"Elite Clock Military Style LED Watch" by ledwatchsuk. YouTube [dated May 31, 2011][online][retrieved on Aug. 14, 2015].

* cited by examiner

EARPHONES OPTIMIZED FOR USERS WITH SMALL EAR ANATOMY

TECHNICAL FIELD

The present disclosure relates generally to the field audio output devices, and more particularly to optimizing sound quality and comfort in earphone audio devices for users having smaller than average ear anatomy.

BACKGROUND

Personal audio devices have been used with increasing regularity in recent years, and people continue to use these devices with greater frequency during of their daily activities (e.g. during exercise sessions, while traveling, while working, while participate in online coursework, etc.). Indeed, headphones have become so commonplace that they are often offered as a complementary gift to patrons of certain venues (e.g. flights, gaming events, etc.). Consequently, engineering optimal headphone devices has become a robust and specialized field requiring advanced technologies to meet the design, aesthetic, and functional requirements of the various users of these devices, and the various activities for which they are used.

Headphones come in a variety of shapes and sizes. One type or category of headphones are referred to as earphones or earbuds. Earphones typically include two small speakers held within two separate, small enclosures configured to fit or rest directly within a user's ear. In many modern earphone devices, a housing portion of the earphone enclosure is meant to rest in or near the user's cavum conchae, while a tip portion of the earphone is designed to fit into an outer portion of the user's ear canal. The speaker is often configured to be held within the tip portion. Because the anatomy of each person's ear is unique, however, earphones that are mass produced do not always provide an adequate fit for each unique user's individual ear anatomy. User's with larger ears may find that the earphones fit to loosely, while user's with smaller ears may find that the earphones fit too snug. This may cause discomfort and irritation.

Many engineers and manufacturers have attempted to remedy this problem by designing and providing cushions in multiple sizes that can be attached to the tip of the earphone (e.g. typically two to three different sizes—small, medium, large—may be provided). However, while a larger cushion can always be designed to accommodate users with larger ears, the design of small cushions is limited by the size of the leading portion of the tip to which the cushion is attached (the part that is meant to be situated in the users ear canal when worn). Some designs eliminate the cushion entirely to further minimize the dimension of the tip in the user's ear, but these still suffer from similar structural limitations of the speaker component disposed therein (described in more detail below). Because of this, such devices remain inadequate for those users having ear canal dimensions much smaller than average.

Finding an adequate remedy to this problem is complicated by the structural limitations and performance requirements of earphone devices.

Structurally, an earphone generally has a plastic or metal enclosure made up of a housing and a tip extending from the housing. The enclosure includes several electronics, including at the very least a speaker component and appropriate wiring. Advanced earphone devices can further include BLUETOOTH wireless connectivity, and thus require the earphone enclosure to include additional electronic components (e.g. a battery, a circuit board, an amplifier, a channel equalizer, a wired or wireless receiver, or other audio-electronic circuitry). Earphone devices typically have a tip extending outward from the remainder of the housing, within which the speaker component is typically disposed, and upon which a silicone or foam cushion may be attached. In earphone devices that utilize such cushions, the size of the cushions that may be used with a particular set of earphones is necessarily limited by the size of the tip. Accordingly, for user's with small ears, decreasing the diameter or thickness dimension of the earbud tip (the part leading into the user's ear canal) is essential to optimizing the overall earphone performance these user's experience—whether cushions are utilized or not.

Noting that the ability to decrease the size of the tip is necessarily limited by the size of the components disposed within the tip (e.g. the speaker), some manufacturers have made other attempts to minimize the tip dimensions. For instance, as indicated above, some manufacturers have designed earphones that forego the cushion entirely, leaving the outer plastic shell of the tip to be the contact interface with the interior of the ear canal. However, even for these earphone devices, the same limitations presented by the speaker component housed within still come into play. That is, the ability to decrease the dimensions of the tip is limited by the size of the components disposed within.

With respect to performance, the capacity of the electronics within an earphones are limited by their size. Of course, the speakers in such earphone devices must be very small in order to fit within the small structure of the enclosure. A speaker functions by pushing and pulling air molecules to generate pockets of high and low pressure that the human eardrum is capable of detecting, and that the human brain is capable of interpreting as sound. As the size of speaker parts (e.g. voice coil, spider, cone, magnet) decrease, so does the speaker's capacity to push and pull air molecules to generate sound. In other words, smaller speakers generate less volume and produce narrower frequency ranges than larger speakers. To some degree, the lower capacity of small speakers can be alleviated by bringing the speaker in close proximity to the user's eardrum (e.g. placing the speaker in the tip portion of the earphone). Indeed, the practical utility of earphone devices depends on their being brought in close proximity with the user's ear drum. The closer the speaker is to a user's eardrum, the easier it is for the human eardrum to detect the pressure fluctuations. Moreover, the closer the speaker is to the user's eardrum, the less noise exists that can interfere with the already small pressure fluctuations. Because of this, and as indicated above, some earphone designs includes a speaker component that is situated at or near the tip of the earbud—the part actually inserted into the user's ear canal. However, as noted, because effective speakers can only be manufactured so small without losing their effectiveness, retaining the speaker at the very tip of the earphone (the portion closest to the user's eardrums when worn) necessarily limits the ability to minimize the dimensions of tip of the earphone for smaller users.

Some engineers have attempted to remedy this problem by designing earphones where the speaker component is moved completely out of the tip and into another portion of the housing so that the earphone tip may be made even smaller. Because the speaker is disposed in a larger portion of the enclosure, the speaker component itself may be made even larger so that it produces more sound. However, problems with this design still exist.

First, the problems highlighted above with regard to the proximity of the speaker component to the user's eardrum are still apparent. In particular, although larger speakers may be used, moving the speaker into the housing still increases distance between the user's eardrum and the speaker component, and thereby increases the effect of noise (i.e. unwanted interference signals) that does not benefit from the natural filtering features of the walls of the ear canal. Second, moving the speaker into the housing means less space for the other components disposed within the housing (e.g. batteries, receivers, channel equalizers, and other components) where space is already limited. For instance, further congesting the earbud housing space with the speaker component might mean having to reduce the size of the battery, which would consequently reduce the time a person can use the earbuds on a single charge. Third, and moreover, the use of larger speakers in earphone housing requires more power to be drawn from the battery that is powering them. So even if the battery size did not need to be reduced, the amount of time a user could operate the earphones on a single charge would be reduced because of the greater amount of power the larger speakers draw during operation. This is of particular concern in wireless earphones that run on a battery with an already limited capacity. Indeed, many other problems with this design exist.

In sum, on the one hand earphones that employ a speaker at the very tip of the earphone will often fit too tightly within a user's ear canal and cause discomfort during use, especially during extended use. In some instances, where the user's ear anatomy is much smaller than average, the inadequacy of the fit may render the earphones entirely unusable. On the other hand, earphones that employ larger speakers enclosed in the housing portion away from the earphone tip suffer from decreased sound quality and operational capacity (e.g. increased noise interference, decreased run-time on a single charge, etc.). The foregoing issues are estimated to affect nearly 10% of earphone users.

Accordingly, there is a long-felt need in this field to adequately resolve the weaknesses apparent in the present devices. Making an earphone tip small enough to accommodate very small ear canal's calls for—in presently earbud models—moving the speaker component out of the earbud tip and into the remainder of the earbud housing so that the tip size can be reduced. But, as discussed, moving the speaker component into the remainder of the housing moves speaker parts further from the user's eardrum, thereby reducing the overall sound quality as described above. Additionally, moving the speaker into the housing means less space for the other components disposed within the housing. This can be particularly problematic for wireless earbuds—which also house batteries, receivers, channel equalizers, and other components—where space within the housing is already limited. For instance, further congesting the earbud housing space with the speaker component might mean having to reduce the size of the battery, which would reduce the time a person can use the earbuds on a single charge.

This dilemma makes it challenging to design earphones that provide an adequate fit for users having small ear canal dimensions, but while still maintaining the sound quality and other advantages (described above) that come from situating the speaker component within the tip of the earbud device.

BRIEF SUMMARY OF EMBODIMENTS

Embodiments of this disclosure provide an improved earphone device optimized to permit a more customized and precise fit for certain users—especially for users whose ear anatomy is much smaller than average—while substantially retaining the speaker component in the tip of the earphone device.

The technology disclosed herein is directed toward audio earphones designed to provide a better fit for users having smaller than average ear anatomy while substantially retaining the sound quality benefits of maintaining the speaker component in the tip portion of the earphone.

Some embodiments of the technology disclosed herein may include a cord; a housing; a step-styled tip including a leading-section, a mid-section, and a base-section; wherein the outer profile of the mid-section is larger than the outer profile of the leading-section, and wherein a speaker component is at least partially disposed within the area enclosed by the mid-section of the step-styled tip. A cord leads into the housing and connects to internal electronic components disposed within the earphone enclosure. The housing contains such electronic components including at least the wiring leading to the speaker component, among other components.

In some embodiments, the step styled tip includes least two subsections that are substantially cylindrical, a leading-section and a mid-section; the leading-section proceeding further into the user's ear than the mid-section, the leading section being configured with a smaller outer diameter than the mid-section. A speaker component mechanically couples to an interior portion of the step-styled tip, and is at least partially disposed within the aperture defined by the interior perimeter of the mid-section of the tip.

Because embodiments of the present technology employ an earphone tip formed in a step-styled manner such that the part proceeding deepest into the user's ear canal (i.e. the leading-portion of the tip) is dimensionally smaller than the part proceeding less deeply into the users ear (i.e. the mid-section of the tip), the earphone is optimized to achieve a reduction in diameter in the leading-section while substantially retaining the speaker component in the tip of the earphone (i.e. closer to the user's eardrum than the housing). Moreover, such embodiments avoid placement of the speaker component entirely within the housing portion of the earphone (i.e. much further away from the user's eardrum when the earphones are worn). Embodiments of the present technology take advantage of the natural anatomy of the human ear, and utilize the fact that the interior dimension of the ear canal is wider at the opening and narrows as it progresses toward the eardrum.

The reduction in tip dimension at the leading-section of the tip, while permitting a slightly larger dimensioned mid-section of the tip wherein to dispose the speaker enables the technology of the present disclosure achieves optimal structure and functionality that (i) provides an earphone with a smaller leading diameter for a better fit for user's with small ear anatomies, (ii) substantially retains the position of the speaker component in the tip of the earphone device and avoid the need to place the speaker component further back into the housing of the earphone, and (iii) allows for less congestion and more space for the other electronic components that may be disposed in the housing (e.g. allow for a larger battery, larger circuit boards, etc.). Embodiments of the present disclosure can be utilized to optimize the sound quality and enhance the overall entertainment experience for user's with smaller than average ear canal anatomy.

In some example embodiments, the speaker component disposed at least partially within the aperture formed by the interior perimeter of the mid-section of the tip may be manufactured with a profile that substantially matches the interior perimeter profile of the tip mid-section, whether substantially cylindrical, parallelepiped, cubical, or other customized shape.

Other features and aspects of the disclosed technology will become apparent from the following detailed description, taken in conjunction with the accompanying drawings, which illustrate, by way of example, the features in accordance with embodiments of the disclosed technology. The summary is not intended to limit the scope of any embodiments described herein, which are defined solely by the claims attached hereto.

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1:
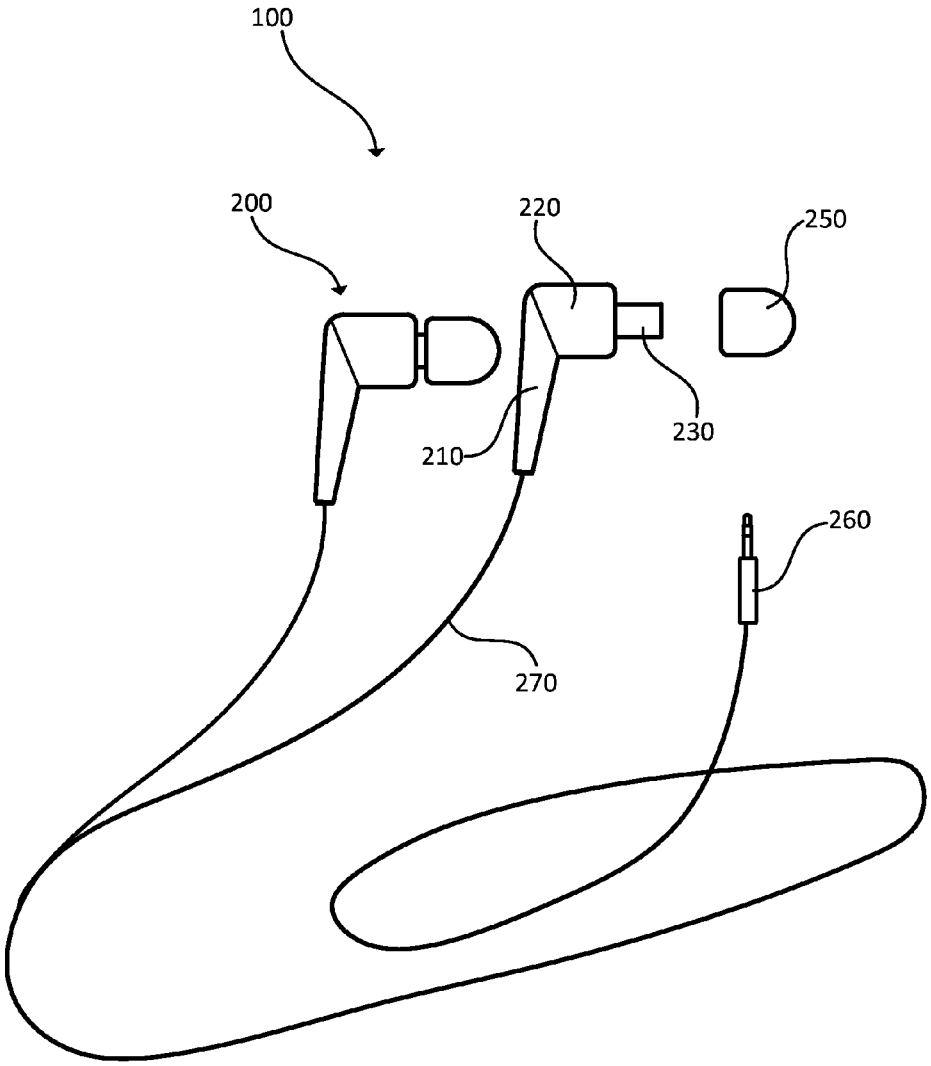
FIG. 1 PRIOR ART
FIG. 1 is a perspective view diagram illustrating an exemplary set of earphones in accordance with typical prior art devices.

The figures are not intended to be exhaustive or to limit the disclosure to the precise form disclosed. The figures are not drawn to scale. It should be understood that the disclosed technology can be practiced with modification and alteration, and that the disclosed technology be limited only by the claims and the equivalents thereof.

DETAILED DESCRIPTION OF THE EMBODIMENTS

The technology disclosed herein is directed toward audio earphones designed to provide a better fit for users having smaller than average ear anatomy while substantially retaining the sound quality benefits of maintaining the speaker component in the tip portion of the earphone.

Some embodiments of the technology disclosed herein may include a cord; a housing; a step-styled tip including a leading-section, a mid-section, and a base-section; wherein the outer profile of the mid-section is larger than the outer profile of the leading-section, and wherein a speaker component is at least partially disposed within the area enclosed by the mid-section of the step-styled tip. A cord leads into the housing and connects to internal electronic components disposed within the earphone enclosure. The housing contains such electronic components including at least the wiring leading to the speaker component, among other components.

In some embodiments, the step styled tip includes least two subsections that are substantially cylindrical, a leading-section and a mid-section; the leading-section proceeding further into the user's ear than the mid-section, the leading section being configured with a smaller outer diameter than the mid-section. A speaker component mechanically couples to an interior portion of the step-styled tip, and is at least partially disposed within the aperture defined by the interior perimeter of the mid-section of the tip.

Because embodiments of the present technology employ an earphone tip formed in a step-styled manner such that the part proceeding deepest into the user's ear canal (i.e. the leading-portion of the tip) is dimensionally smaller than the part proceeding less deeply into the users ear (i.e. the mid-section of the tip), the earphone is optimized to achieve a reduction in diameter in the leading-section while substantially retaining the speaker component in the tip of the earphone (i.e. closer to the user's eardrum than the housing). Moreover, such embodiments avoid placement of the speaker component entirely within the housing portion of the earphone (i.e. much further away from the user's eardrum when the earphones are worn). Embodiments of the present technology take advantage of the natural anatomy of the human ear, and utilize the fact that the interior dimension of the ear canal is wider at the opening and narrows as it progresses toward the eardrum.

The reduction in tip dimension at the leading-section of the tip, while permitting a slightly larger dimensioned mid-section of the tip wherein to dispose the speaker enables the technology of the present disclosure achieves optimal structure and functionality that (i) provides an earphone with a smaller leading diameter for a better fit for user's with small ear anatomies, (ii) substantially retains the position of the speaker component in the tip of the earphone device and avoid the need to place the speaker component further back into the housing of the earphone, and (iii) allows for less congestion and more space for the other electronic components that may be disposed in the housing (e.g. allow for a larger battery, larger circuit boards, etc.). Embodiments of the present disclosure can be utilized to optimize the sound quality and enhance the overall entertainment experience for user's with smaller than average ear canal anatomy.

In some embodiments, the proximal end of the housing is shaped to form an aperture that matches an outside radial profile of the cord and a distal end of the cord is disposed within and secured by the proximal end of the housing. In other embodiments, the housing is further coupled to a strain relief, the distal end of the strain relief being mechanically coupled to a side of the housing. In some such embodiments, the proximal end of a strain relief may be shaped to form an aperture that matches an outside radial profile of the cord and a distal end of the cord is disposed within and secured by the strain relief.

In some example embodiments, the housing is a rigid shell that surrounds electronic components. For example, the electronic components may include a battery or audio-electronic components such as a circuit board, an amplifier, a channel equalizer, a receiver (e.g., a wired or a wireless receiver), or other audio-electronic circuitry. The rigid shell may be made with plastic, metal, rubber, or other materials known in the art. The housing may be cubic shaped, prism shaped, tubular shaped, cylindrical shaped, or otherwise shaped to house the electronic components.

In some example embodiments, the speaker component disposed at least partially within the aperture formed by the interior perimeter of the mid-section of the tip may be manufactured with a profile that substantially matches the interior perimeter profile of the tip mid-section, whether substantially cylindrical, parallelepiped, cubical, or other customized shape.

In some embodiments the distal end of the housing is shaped to form an aperture that matches an outside radial profile of the proximal end of tip. The proximal end of the tip may be a mid-section of the tip or a base-section of the tip. The proximal end of the speaker component may be threaded, and the aperture boundary formed at the distal end of the housing boundary be likewise be reciprocally threaded to receive the proximal end of the speaker component. Accordingly, in some embodiments the speaker component may be mechanically coupled to the housing by being threaded thereto. In other embodiments, the distal end of the housing and the proximal end of the tip are mechanically coupled in any method known in the art (e.g. plastic welding, snap-fit, adhesive, etc.), and it is noted that any such method may be used without departing form the scope of the technology disclosed herein.

In some embodiments, electronic wires may be disposed within the cord. The electronic wires may carry power and other electronic signals to the electronic components of the earphone from a controller and/or other electronic components housed within or fixed to another earphone. Accordingly, some example embodiments may include a strain relief that is rigid or semi-flexible and configured to secure the cord in place and absorb any tension applied to the cord from an external source, as to reduce the tension that would have otherwise been translated to connection or solder joints between the electronic wires and the electronic components within the housing.

In an effort to explain in detail the novelty of the presently disclosed technology, a detailed discussion of certain exemplars (FIGS. 1-2D) found in the prior art is provided below to illustrate one or more of the weaknesses (described above) which the presently disclosed technology overcomes. While other weaknesses exist that are not explicitly depicted (e.g. cost savings, battery-life, etc.), these will be appreciated by one of ordinary skill in the art in view of the following disclosure.

FIG. 1 is a perspective view diagram illustrating an exemplary set of earphones in accordance with typical prior art devices. As illustrated, the external structure of each earphone 200 can be described generally as having a strain relief 210, a housing 220, a tip 230 and a cushion 250. Each earbud 200 contains electronic components configured to receive audio signals from an audio device through wires disposed within cord 270 and connected to an audio device via auxiliary connector 270. In some earbud devices, the strain relief 210, housing 220 and tip 230 are joined together by a plastic weld, adhesive, or other fastening mechanism. Though not depicted in FIG. 1, earbuds 200 may be configured to receive audio signals wirelessly, via BLUETOOTH for example, and thereby only be connected to one another via cord 270, eliminating the auxiliary connector 260 altogether.

Figure 2B:
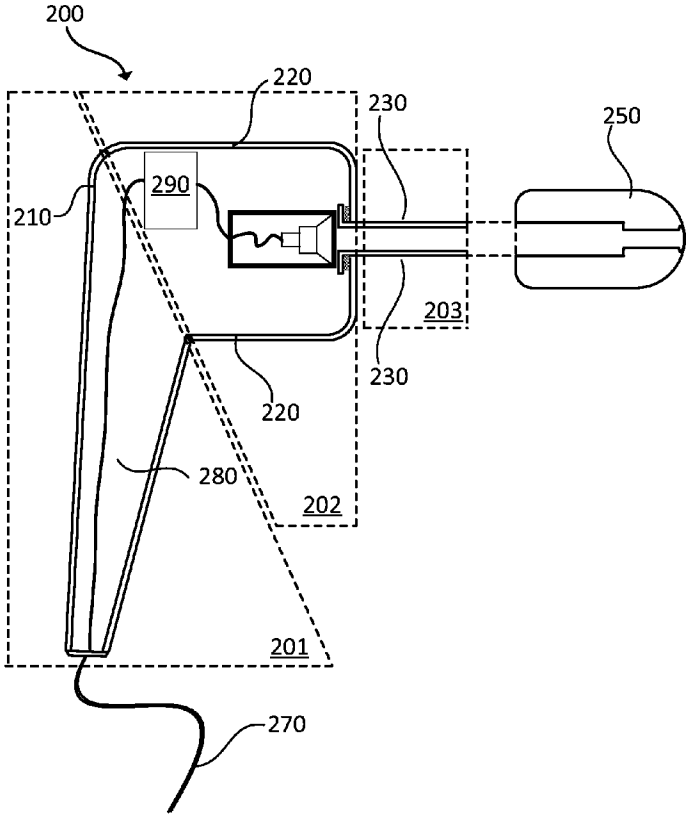
FIG. 2B PRIOR ART
FIG. 2B is a cross-section side view of another exemplary earphone including a second representation of certain internal electronic components in accordance with some prior art devices.
Figure 2A:
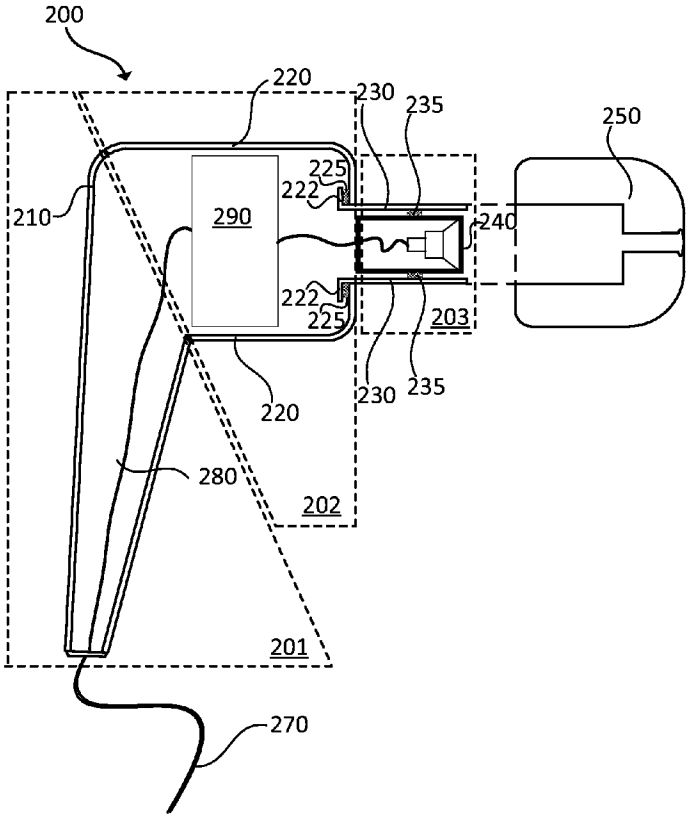
FIG. 2A PRIOR ART
FIG. 2A is a cross-section side view of an exemplary earphone including a first representation of certain internal electronic components in accordance with some prior art devices.

FIG. 2A is a cross-section side view of an exemplary earphone including a simplified architectural deployment of certain internal electronic components in accordance with some typical prior art devices. FIG. 2A depicts the side view of a typical earphone 200, the cushion 250 being depicted as having been removed from the tip 230 for clarity of discussion. As illustrated, an earphone enclosure can be generally described as having three general portions, a strain relief portion 201, a primary housing portion 202, and a tip portion 203, each of which may be joined by a plastic weld joint 215, or by an adhesive 225 applied between overlapping portions, or by other similar mechanisms used to create an assembled unit. Additionally, many earphone devices are designed such one or more of these portions are formed as a single unit. Thus, in some devices the strain relief portion 203 and the primary housing portion 202 are formed as a single piece which is later joined with the tip portion 203; or the primary housing portion 202 and the tip portion are formed as a single piece that is later joined with the strain relief portion 201; or other combinations that may or may not include all of these portions. Indeed, some earbud devices do not include a strain relief portion 201 at all, the enclosure being defined solely by a primary housing portion 202 and tip portion 203. However, for clarity of description, this disclosure will refer to these three general portions separately, a person of ordinary skill in the art understanding that the various arrangements discussed above may be implemented without departing from the scope of the technology disclosed herein.

As depicted in FIG. 2A, the strain relief portion typically includes the strain relief 210 enclosure itself with appropriate wires disposed within to facilitate signal communication between components and devices. The primary housing portion 202 typically includes the housing 220 enclosure itself, enclosing various electronic components 290 (only symbolically represented by box 290) and wires to support audio functionality. The tip portion 203 typically includes a tube 230 extending from the housing 220 and enclosing a speaker component 240. As depicted, an adhesive 235 or other attachment mechanism may be disposed between the exterior of the speaker component 240 and the inside wall of the tube 230 to secure the speaker component 240 within the tube 230. As further depicted in FIG. 2, many common earphone devices include a cushion 250. In some such devices, an aperture within the cushion 250 is typically fitted to the outside wall of the tube 230 such that the cushion 250 may be easily attached to and detached from the tube 230 of the earbud. In other devices, no cushion 250 is employed, and the material of tip 230 itself is configured to contact the inside perimeter of the user's ear canal when worn.

As discussed, because the speaker component 240 is substantially disposed within and along the length of the tube 230 in FIG. 2A, the dimensions of the tube 230—and overall dimensions of the tip 203—must be at least as large as the dimensions of the speaker component 240. Because speaker components can only be made so small while retaining their effectiveness, the earphones employing such a design cannot be made small enough to adequately accommodate user's with ear anatomies much smaller than average. As discussed previously, some have attempted to remedy this problem by designing earphones where the speaker component is moved completely out of the tip and into a portion of the housing so that the earphone tip portion may be made even smaller. This arrangement is depicted in FIG. 2B.

FIG. 2B is a cross-section side view of another exemplary earphone including a second representation of certain internal electronic components in accordance with typical prior art devices. In particular, the representation in FIG. 2B depicts an arrangement where the speaker component 240 is moved entirely out of the tip portion 203 and disposed instead in the housing portion 202 of the earphone 200. As may be recognized by a comparison between FIG. 2A and FIG. 2B, the dimensions of the tip 203 in FIG. 2B may be made smaller than those in FIG. 2A by moving the speaker out of the tip portion 203 and into the housing portion 202. Although the speaker component is depicted in FIG. 2B as being the same size as the speaker component in FIG. 2A, it is common for larger speakers to be used is configurations such as that depicted in FIG. 2B (i.e. when placed in the housing component) in order to make up for the signal power and sound quality that is lost in moving the speaker component further away from the user's eardrum. Further details in about these prior art arrangements are discussed in more detail in connection with FIGS. 2C-2D.

Figure 2C:
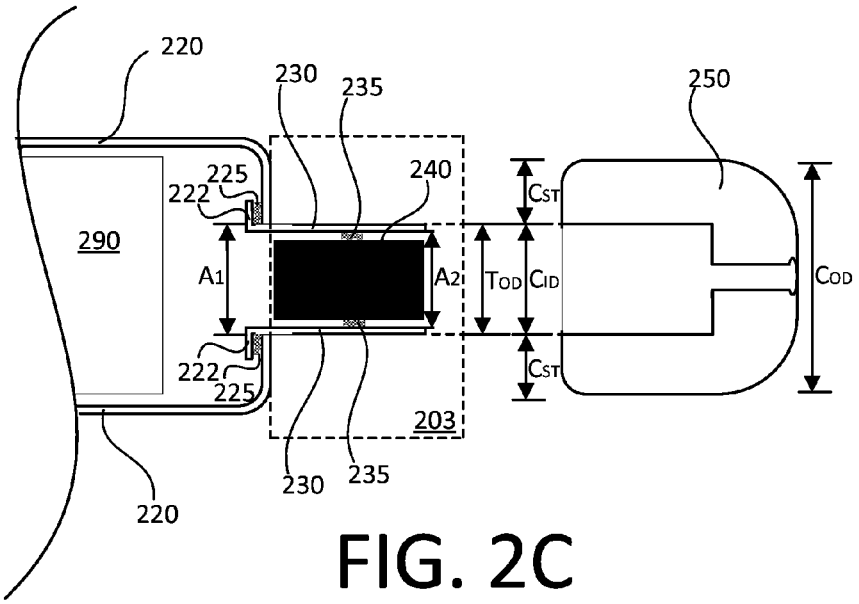
FIG. 2C PRIOR ART
FIG. 2C is an exploded cross-section side view of the earphone depicted in FIG. 2A, including a view of the tip of the earphone as well as a distal portion of the housing and corresponding architecture.
Figure 2D:
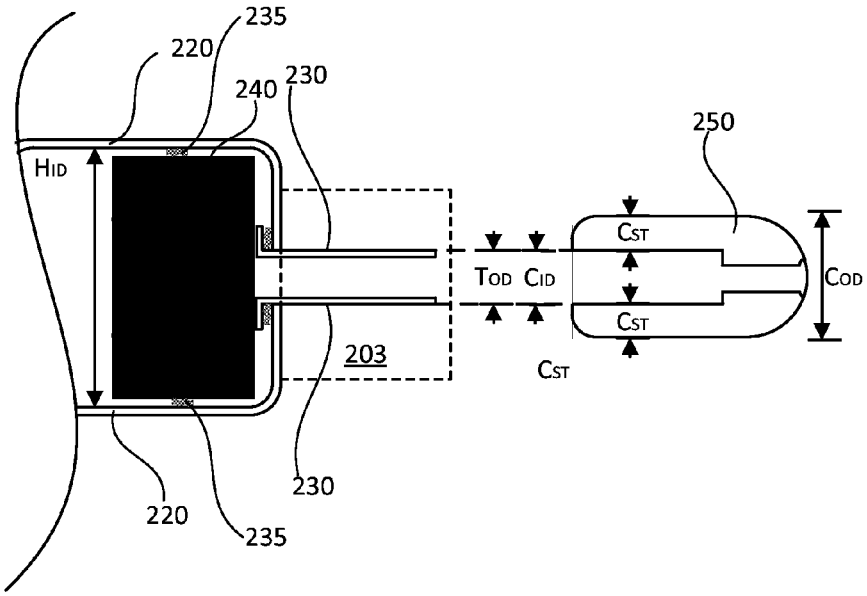
FIG. 2D PRIOR ART
FIG. 2D is an exploded cross-section side view of the earphone depicted in FIG. 2B, including a view of the tip of the earphone as well as a distal portion of the housing and corresponding architecture.

FIG. 2C illustrates an exploded cross-section side view of the prior art earphone enclosure described in FIG. 2A, but including further dimension labels to add clarity and aid in description. FIG. 2D illustrates an exploded cross-section side view of the prior art earphone enclosure described in FIG. 2B, also including more detailed dimension labels but here depicting an enlarged speaker component for illustration.

In each of FIGS. 2C and 2D, the cushion 250 is included and depicted in a position removed from the tip 203. Though not always employed, a common arrangement includes, as illustrated in FIGS. 2C and 2D, the tube 230 formed with a flange 222 extending radially outward from a proximal end of the tube 230, an adhesive 225 or other coupling component disposed between the flange 222 and inside wall of the housing 220 to secure the tube 230 to the housing 220 of the earphone 200. The housing 220 may be formed with an aperture of dimension (e.g. diameter, height, etc.), to allow a space wherein a portion of tube 230 may be situated, and providing access to the interior wall of the housing 220 to which flange 222 of the tube 230 may be attached. Additionally, the tip 203 of an earphone is often formed with an aperture of dimension, which is often covered in part by a filter or other protective material (not depicted).

As can be seen in FIG. 2C, for earphones that employ cushions, the cushion 250 is at least partially hollow, the aperture defining the hollow having a dimension defined as. As illustrated in FIG. 2C, the internal dimension of the cushion must accommodate the outside dimension, defined by the exterior wall of the tube 230 defining the outer perimeter of the tip portion 203. In particular, presently available earbud devices require that the cushion 250 be formed such that its inside dimension (e.g. diameter, height, etc.), is at least as large as the outside dimension (e.g. diameter, height, etc.), of the tube 230 when the cushion 250 is secured in place around the tube 230 during use. And though the cushion 250 may be made of a formidable material with a relaxed smaller than the outer dimension of tube 230, the cushion 250 must ultimately stretch to conform to the outer perimeter of the tube 230 when placed on the tube during use. That is, the smallest, dimension fitting round the tube 230 in currently available earbuds can never be less than the smallest dimension of the tube 230 upon which it is situated.

As illustrated further by FIG. 2C, the outside dimension of the tube, must be at least as large as the combined respective dimensions of the speaker component 240, the adhesive 235 (or other attachment mechanism that may be employed) and the thickness of the material used for the tube 230 enclosure itself. Consequently, the smallest dimension, for the tip portion 203 must be at least as large as the largest dimension of the components enclosed therein. Furthermore, while recognizing that many modern devices have done away with cushions altogether (not depicted in FIGS. 2A-2D), it is noted that those that still employ cushions must reconcile in their design the fact that the outer dimension, of the cushion 250 can only be as small as permitted by the outer dimension, of the tube 230, the outer dimension of the tube 230 further being limited by the size of the components enclosed within. Of course, this limits the ability for such devices to accommodate user's with ear anatomies much smaller than average. As a result, and as described above, many manufacturers have moved to a different design that moves the speaker component out of the tip portion and into the housing as depicted in FIG. 2D.

Similar to FIG. 2C, the earphone in FIG. 2D shows also that the internal dimension of the cushion must accommodate the outside dimension, of the exterior wall of the tube 230 defining the outer perimeter of the tip portion 203. But unlike FIG. 2C, the earphone tip 203 dimensions are not constrained by the size of the speaker component 240 because speaker component 240 has been moved out of the tip 203 and into the housing 220. As such, the tip dimensions may be manufactured to display a much smaller dimension. For earphones that employ cushions, this permits cushions 250 having much smaller dimensions, etc. However, as noted, moving the speaker component 240 out of the tip 203 and into the housing 220 displaces to too great an extent the speaker component's proximity to the user's eardrum when the earphone is worn. And even though, as depicted in FIG. 2D, a much larger speaker component 240 may be used in such architectures in an attempt to counter the aforementioned disadvantages, sound quality and performance is nevertheless compromised in many regards. In particular, (i) the sound wave produced by the speaker will be susceptible to an increased amount of noise interference because of the increased distance of the speaker from the user's eardrum (ii) placing the speaker component further back into the housing of the earphone reduces the space available in the housing for other electronic components, and gives rise to a more congested enclosure. This often demands a redesign of the housing components, including in some instances using a smaller battery, smaller circuitry, etc. which can lead to greater expense.

Figure 3C:
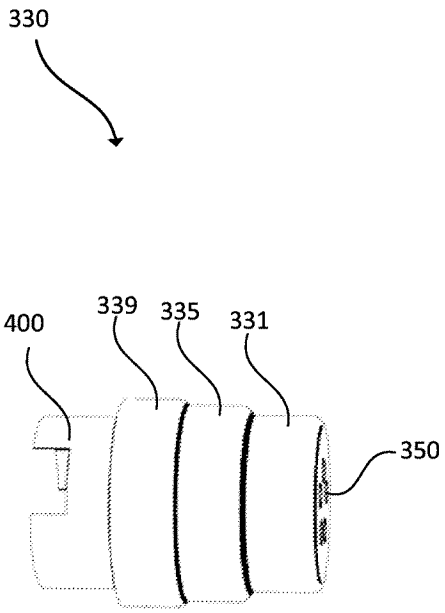
FIG. 3C is a perspective side view of the step-styled tip portion of the earphone depicted in FIGS. 3A-3B, the tip being illustrated as disassembled from the remainder of the earphone for clarity.
Figure 3B:
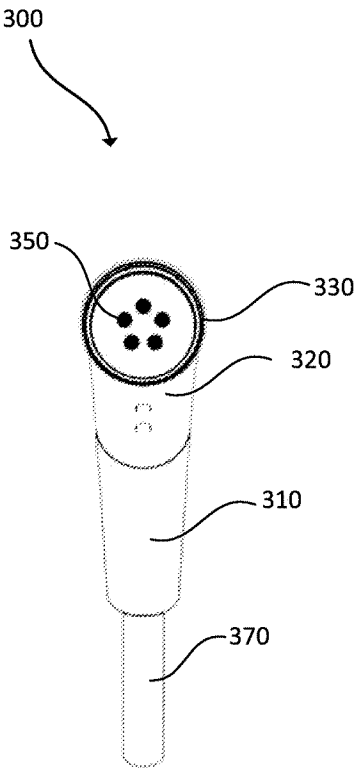
FIG. 3B is a perspective frontal view of the earphone embodiment depicted in FIG. 3A, in accordance with one embodiment of the present technology.
Figure 3A:
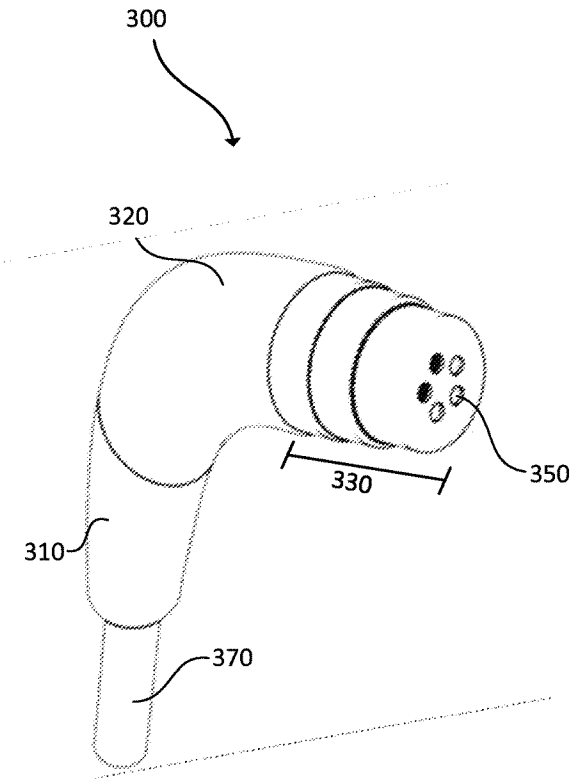
FIG. 3A is a perspective side view of an earphone in accordance with one embodiment the present technology, including a step-styled tip.

FIG. 3A is a perspective side view of an earphone with an optimized step-styled tip in accordance with one embodiment the present technology. FIG. 3B is a perspective frontal view of the same earphone depicted in FIG. 3A in accordance with one embodiment of the present technology. As depicted, earphone 300 includes a cord 370, a strain relief 310, a housing 320, and a step-styled tip 330 optionally configured with one or more holes 350 through which sound may pass. As shown, a proximal end of strain relief 310 is configured with an aperture having a dimension substantially matching the outer radial profile of cord 370; cord 360 containing wiring leading into the earphone enclosure to connect and power the various electronic components disposed therein (not depicted). Strain relief 310 is coupled to housing 320 which is further coupled to tip 330. The coupling mechanism between cord 370, strain relief 310, housing 320 and tip 330 may be effectuated by plastic welding, snap fitting, or any other mechanism known in the art, as a person with ordinary skill in the art will readily appreciate. Earphone 300 also includes a speaker (not shown) disposed within a portion of the step-styled tip 330.

FIG. 3C is a perspective side view of the tip portion of the earphone depicted in FIGS. 3A-3B, the tip portion being disassembled from the remainder of the earphone. As depicted, earphone tip 330 includes leading section 331, mid-section 335, base section 339, and coupler 400. The outer perimeter of leading-section 331 is smaller than the outer perimeter of mid-section 335 in at least one dimension. Similarly, the outer perimeter of mid-section 335 is dimensionally smaller than outer perimeter of base-section 339. As noted herein, the human ear canal gradually decreases in dimension proceeding from the opening of the ear canal (i.e. the outer ear canal) toward the eardrum. Taking advantage of this anatomical feature, embodiments of the present disclosure include a step-styled earphone tip displaying a similar gradual decrease in tip dimension proceeding from the proximal end of the tip 330 to the distal end of tip 330. Embodiments employing the step-styled tip of the present disclosure enable the most distal portion of the tip (i.e. the leading-section 331) to be sized down to accommodate smaller ear canal anatomies without the constraint of having the speaker component disposed therein. At the same time, embodiments employing the step-styled tip of the present disclosure can minimize the disadvantageous effects of moving the speaker further away from the eardrum by minimizing the distance the speaker actually must be moved in to accommodate smaller ear canal anatomies. Indeed, as depicted in more detail in FIGS. 4A-4B, the speaker component may be at least partially disposed within the mid-section 335 of the tip 330 leading up to the leading-section 331 of the tip 330.

Figure 4A:
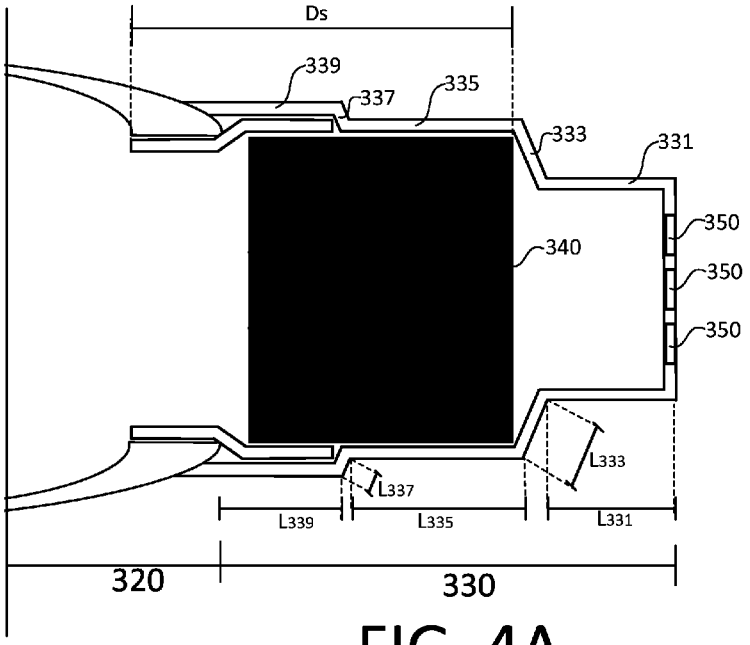
FIG. 4A is an exploded two dimensional schematic representation of the cross-section view of an exemplary earbud tip in accordance with some embodiments of the technology disclosed herein.

FIG. 4A is an exploded two-dimensional schematic cross-section view of an exemplary step-styled earphone tip in accordance with embodiments of the technology disclosed herein. As illustrated, step-styled tip 330 includes leading-section 331 of length L331, mid-section 335 of length L335, and base-section 339, with step segment 333 of length L333 joining the proximal end of leading-section 331 to the distal end of mid-section 335, and with step segment 337 of length L337 joining the proximal end of mid-section 335 to the distal end of base-section 339. Speaker component 340 (depicted for simplicity and emphasis by a black box) is disposed at least partially within the aperture defined by the inside perimeter of mid-section 335. Accordingly, because the speaker is slightly displaced from the distal most end of the tip (i.e. leading-section 331), and is disposed in aperture formed by the mid-section 335 of the step-styled tip 330, the leading-section 331 of tip 330 may be formed with a smaller dimension than would otherwise be possible if speaker 340 were required to be disposed within the aperture formed by leading-section 331. At the same time, speaker component 340 may be kept in closer proximity to the user's eardrum when worn, at least by a distance Ds as compared with earphone devices that deploy the speaker component entirely within the housing 320 (as depicted in FIGS. 2B and 2D).

Figure 4B:
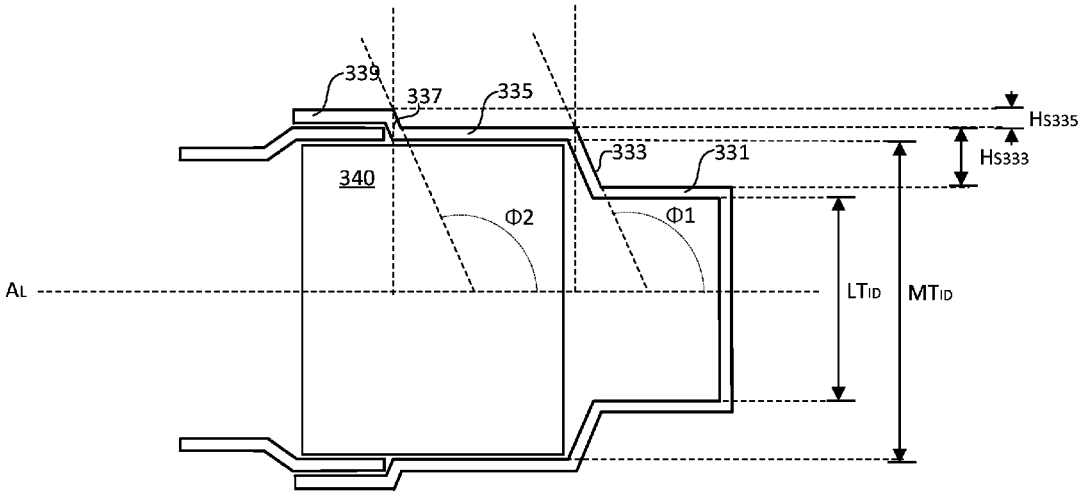
FIG. 4B is an exploded two dimensional schematic representation of the cross-section view of the exemplary earbud tip shown in FIG. 4A.

FIG. 4B is another exploded schematic of the cross-section view of the exemplary step-styled earphone tip shown in FIG. 4A, here defining additional dimensions of the step-styled earphone tip for more detailed discussion of some embodiments of the present technology. In some embodiments, as depicted in FIG. 4B, step segment 333 is substantially straight and forms an angle ϕ1 with a positive x-axis defined by longitudinal axis $A_L$. Similarly, step segment 337 may be substantially straight and form an angle ϕ2 with a positive x-axis defined by longitudinal axis $A_L$. As depicted, angle ϕ1 and angle ϕ2 are greater than 90 degrees but less than 180 degrees such that the inner dimension of the mid-section 335, defined by $MT_{ID}$ is greater than the inner dimension leading-section $LT_{ID}$. As depicted, speaker component 340 is at least partially disposed within the aperture formed by mid-section 335 and thus be as large as the $MT_{ID}$ dimension depicted without constraining the $LT_{ID}$ dimension. Accordingly, the leading-section 331 may display an $LT_{ID}$ dimension suitable for a deeper region within the user's ear canal that is more narrow, while the mid-section 335 may display an $MT_{ID}$ dimension suitable for a region less deep within the user's ear canal (i.e. nearer the ear canal opening and having a larger dimension). As depicted, the $MT_{ID}$ dimension of the mid-section 335 is large enough to accommodate the speaker component 340 such that the speaker component 340 need not be placed entirely within the housing 320.

Although the embodiment depicted in FIGS. 4A and 4B depict step-segments 333 and 337 as being substantially straight and forming exact angles with the earphone tip's longitudinal axis, $A_L$, it should be noted that the step segments may be rounded—taking on an arc shape other curvilinear form—without departing from the scope of the technology disclosed herein. In still further embodiments, the interior wall of one or more of step-segments 333 and 337 may be substantially straight while the exterior wall of such segments is rounded, or vice versa. In such embodiments angle ϕ1 and angle ϕ2 may be defined as the angle made between a line tangent to such an arc or curvilinear form at an inflection point (or other point along the curve). Similarly, although the embodiment depicted in FIGS. 4A and 4B as having a base-section 339, mid-section 335, and leading-section 331 defined by walls that run substantially parallel to the tip's longitudinal axis, $A_L$, it should be noted that the base-section 339, mid-section 335, and leading-section 331 may be angled with respect to the longitudinal axis, $A_L$, without departing from the scope of the technology disclosed here. Indeed, in some embodiments, the arrangement of base-section 339, mid-section 335, and leading-section 331 relative to step-segments 333 and 337 may appear as a continuous integral form, tapering from a wider aperture within the tip where the tip 330 attaches to the housing to a narrower aperture near the distal most portion of the tip 330 (i.e. the portion that proceeds deepest into the user's ear canal).

It should also be noted that while embodiments of the various sections of the step-styled tip shown in FIGS. 3A-3C are depicted as having a substantially tubular or cylindrical form, the tip may take on various other forms without departing from the scope of the technology presented herein. For example, the tip 330 and its corresponding leading-section 331, mid-section 335, and base-section 339 may be parallelepiped, cubical, or other customized shapes while still employing the technology disclosed herein.

Embodiments of the present disclosure enable earphone and earbud designers and manufacturers to optimize earphones in a variety of ways, including but not limited to: (i)

configuring the tip portion of an earphone to be small enough to accommodate users with smaller ear anatomies, while (ii) disposing the speaker component at least partially within the tip portion of the earphone (albeit slightly displaced from the distal-most end of the tip), and often (iii) substantially if not entirely retain the size of the speaker components currently used.

As noted, nearly 10% of the population, particularly petite persons and youth, find difficulty or discomfort trying to fit the earphone tip of current earphone models into their ear canal. Embodiments of the present disclosure enhance the comfort level and user experience of these and other users by allowing for the leading portion of the earphone tip to take on a smaller dimension—thereby satisfying size constraints specific to the user—while also minimizing the distance the speaker is displaced from the user's ear drum to allow for the smaller leading-section—thereby substantially retaining the proximity of the speaker component within the user's ear canal to provide optimal sound quality.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

We claim:

1. An earphone comprising:

a speaker component configured to generate sound;

a housing; and a tip coupled to the housing, the tip having a length extending away from the housing in a first direction and comprising:

a first section extending to a leading end of the tip and having a first aperture at least partially formed by an interior wall of the first section, the first section further including an outer profile that forms a first exterior surface of the tip and the earphone; and a second section having a second aperture at least partially formed by an interior wall of the second section, the second section further including an outer profile that forms a second exterior surface of the tip and the earphone, wherein the second section is disposed between the first section and the housing, a largest thickness dimension in a second direction across the outer profile of the first section of the tip is smaller than a largest thickness dimension in the second direction across the outer profile of the second section of the tip, the second direction substantially perpendicular to the first direction, the speaker component is at least partially disposed within the second aperture, the speaker component includes a first portion disposed outside of the housing and extending towards the first section inside the tip, and a largest thickness dimension in the second direction across an outer profile of the speaker component is larger than a largest thickness dimension in the second direction across an inner profile of the first aperture in at least one dimension.

2. The earphone of claim 1, wherein a distal end of the second section of the tip is coupled to a proximal end of the first section of the tip; and wherein a proximal end of the second section of the tip is coupled to a distal end of the housing.

3. The earphone of claim 1, the tip further comprising:

a base-section, wherein the largest thickness dimension in the second direction across the outer profile of the second section of the tip is smaller than a largest thickness dimension in the second direction across an outer profile of the base-section of the tip.

4. The earphone of claim 3, wherein a distal end of the base-section of the tip is coupled to a proximal end of the second section of the tip, and wherein a proximal end of the base-section of the tip is coupled to a distal end of the housing.

5. The earphone of claim 1, wherein the outer profile of the second section of the tip is configured to fit at least partially in a human ear canal.

6. The earphone of claim 1, wherein no portion of the speaker component extends into the first aperture.

7. The earphone of claim 1, wherein no portion of the speaker component extends into the housing.

8. The earphone of claim 1, wherein a largest outer dimension across the first section of the tip in the second direction is not greater than 8 millimeters.

9. The earphone of claim 1, wherein a largest outer dimension across the speaker component in the second direction is between 4 millimeters and 8 millimeters.

10. The earphone of claim 1, wherein a largest interior dimension across the second section of the tip in the second direction is equal to or greater than a largest exterior dimension across the first section of the tip in the second direction.

11. An earphone comprising:

a speaker component configured to generate sound;

a housing; and a hollow tip coupled to the housing and having a length extending away from the housing in a first direction and, the hollow tip comprising:

a first section extending to a leading end of the tip and having a substantially cylindrical radial outer profile that forms a first exterior surface of the hollow tip and the earphone;

a second section having a substantially cylindrical radial outer profile that forms a second exterior surface of the hollow tip and the earphone, wherein a largest thickness dimension in a second direction across the outer profile of the first section of the hollow tip is smaller than a largest thickness dimension in the second direction across the outer profile of the second section of the hollow tip, and the second direction is substantially perpendicular to the first direction;

a first aperture at least partially formed by an interior wall of the first section of the hollow tip; and a second aperture at least partially formed by an interior wall of the second section of the hollow tip, wherein the second section is disposed between the first section and the housing, the speaker component is at least partially disposed within the second aperture, the speaker component includes a first portion disposed outside of the housing and extending towards the first section inside the tip, and a largest thickness dimension in the second direction across an outer profile of the speaker component is larger than a largest thickness dimension in the second direction across an inner profile of the first aperture in at least one dimension.

12. The earphone of claim 11, wherein a distal end of the second section of the hollow tip is coupled to a proximal end of the first section of the hollow tip, and wherein a proximal end of the second section of the hollow tip is coupled to a distal end of the housing.

13. The earphone of claim 11, the hollow tip further comprising:

a base-section having a substantially cylindrical radial outer profile, wherein the largest thickness dimension in the second direction across the outer profile of the second section of the hollow tip is smaller than a largest thickness dimension in the second direction across the outer profile of the base-section of the hollow tip.

14. The earphone of claim 13, wherein a distal end of the base-section of the hollow tip is coupled to a proximal end of the second section of the hollow tip, and wherein a proximal end of the base-section of the hollow tip is coupled to a distal end of the housing.

15. The earphone of claim 11, wherein the outer profile of the second section of the hollow tip is configured to fit at least partially in a human ear canal.

16. The earphone of claim 11, wherein no portion of the speaker component extends into the first aperture.

17. The earphone of claim 11, wherein no portion of the speaker component extends into the housing.

18. The earphone of claim 11, wherein a largest outer dimension across the first section of the hollow tip in the second direction is not greater than 8 millimeters.

19. The earphone of claim 11, wherein a largest outer dimension across the speaker component in the second direction is between 6 millimeters and 8 millimeters.

20. The earphone of claim 11, wherein a largest interior dimension across the second section of the hollow tip in the second direction is equal to or greater than a largest exterior dimension across the first section of the hollow tip in the second direction.

* * * * *